US006786664B2

(12) United States Patent
Claramunt et al.

(10) Patent No.: US 6,786,664 B2
(45) Date of Patent: Sep. 7, 2004

(54) ACTIVE VACUUM ROLLER AND METHOD FOR ADVANCING MEDIA

(75) Inventors: David Claramunt, Barcelona (ES); Xavier Gros, Barcelona (ES); Abel Marron, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 108 days.

(21) Appl. No.: 10/002,014

(22) Filed: Oct. 26, 2001

(65) Prior Publication Data

US 2003/0079631 A1 May 1, 2003

(51) Int. Cl.[7] ..... B41J 11/08; B41J 13/10; B41J 11/02; B65H 5/22

(52) U.S. Cl. ..... 400/656; 400/648

(58) Field of Search ..... 271/276; 400/648, 400/656, 617, 618; 346/134, 136

(56) References Cited

U.S. PATENT DOCUMENTS

| | | | | | |
|---|---|---|---|---|---|
| 4,734,987 | A | * | 4/1988 | Cleveland | 33/18.1 |
| 4,840,369 | A | * | 6/1989 | Takahashi | 271/276 |
| 6,038,776 | A | * | 3/2000 | Yamada et al. | 33/18.1 |
| 6,234,472 | B1 | | 5/2001 | Juan | 271/194 |

FOREIGN PATENT DOCUMENTS

| | | | | |
|---|---|---|---|---|
| DE | 19929319 A1 | * | 12/2000 | B41J/2/005 |
| JP | 62185652 A | * | 8/1987 | B65H/5/22 |
| JP | 04220347 A | * | 8/1992 | B41J/2/01 |
| JP | 2000351499 A | * | 12/2000 | B65H/20/12 |
| JP | 2001335183 A | * | 12/2001 | B65H/5/22 |

* cited by examiner

*Primary Examiner*—Daniel J. Colilla

(57) ABSTRACT

A media advancing device for a hardcopy apparatus includes at least one roller having an outer surface and being rotatable for advancing media, and a negative pressure mechanism. The outer surface further comprises a plurality of openings and a contact region for engaging the media, wherein the negative pressure mechanism is capable of creating negative pressure through at least a portion of the openings in the contact region.

21 Claims, 6 Drawing Sheets

ACTIVE VACUUM ROLLER AND METHOD FOR ADVANCING MEDIA

BACKGROUND OF THE INVENTION

1. Field of the Invention

The present invention generally relates to hardcopy apparatus, such as copiers, printers, scanners, and facsimiles, and more particularly to improved media advancing devices for such apparatus.

2. Description of the Prior Art

In hardcopy apparatus and particularly in apparatus handling media of large size, such as large format printers, printed media is outputted from the printer by means of outputting devices that may damage the quality of the printout. Conventional outputting devices, in order to advance the printed media, employ elements for holding the media having direct contact with the printed surface. This may cause markings on the media, ink smearing and other adverse affects on the print appearance.

As an example, the prior art has employed pinch wheels on top of the overdrive roller for outputting printed media. These devices may damage the printout with pinch wheel marks and further require the need to employ a mechanism or a structure to hold the pinch wheels.

To overcome the problem of adverse affects on the print appearance, U.S. Pat. No. 6,234,472 discloses a media holddown device including a vacuum holddown output unit for holding at least a portion of the media down onto a surface of the outputting mechanism. Thus, the device allows holding of the media without direct contact with the printed surface. The vacuum holddown output unit includes a platen having a continuous waved slot that allows for even distribution of a vacuum along the print zone. To advance the media, this device employs a plurality of overdrive wheels with a gap between the overdrive wheels and the surrounding platen. The vacuum is supplied through these gaps and tangentially results in a negative pressure distribution upon the overdrive roller in the area of the outer surface that engages the back of the media. Rotation of the overdrive wheels, that are frictionally engaging a portion of the back of the media due to the negative pressure distribution, advances the media for output. However, the negative pressure distribution of this device provides a limited traction force as a result of the vacuum being tangentially applied to the area of media contact on the overdrive wheels.

Experiments by the present applicant show that such conventional designs behave in such a way that the overdrive wheels begin to act as a friction load for the media advance when the vacuum levels are increased.

The present invention provides an improved media advancing device and method for advancing a printed media in a hardcopy apparatus with increased traction force. The present invention also provides an advancing device that allows for smaller trailing margins.

SUMMARY OF THE INVENTION

A media advancing device for a hardcopy apparatus comprising at least one roller having an outer surface and rotatable for advancing media, and a negative pressure mechanism; the outer surface comprising a plurality of openings and a contact region for engaging the media, wherein the negative pressure mechanism is capable of creating negative pressure through at least a portion of the openings in the contact region.

Preferably, the negative pressure mechanism comprises one vacuum source in fluid communication with one vacuum chamber, the vacuum chamber being in fluid communication with at least a portion of said openings in said contact region. More preferably, the vacuum chamber further comprises at least one slot, wherein the at least one roller is partially housed in the at least one slot such that the openings in the contact region provide the only entrance for air through the at least one slot into the vacuum chamber.

The present invention will be described further, by way of example only, with reference to an embodiment thereof as illustrated in the accompanying drawings.

DESCRIPTION OF THE PREFERRED EMBODIMENT

Figure 1:
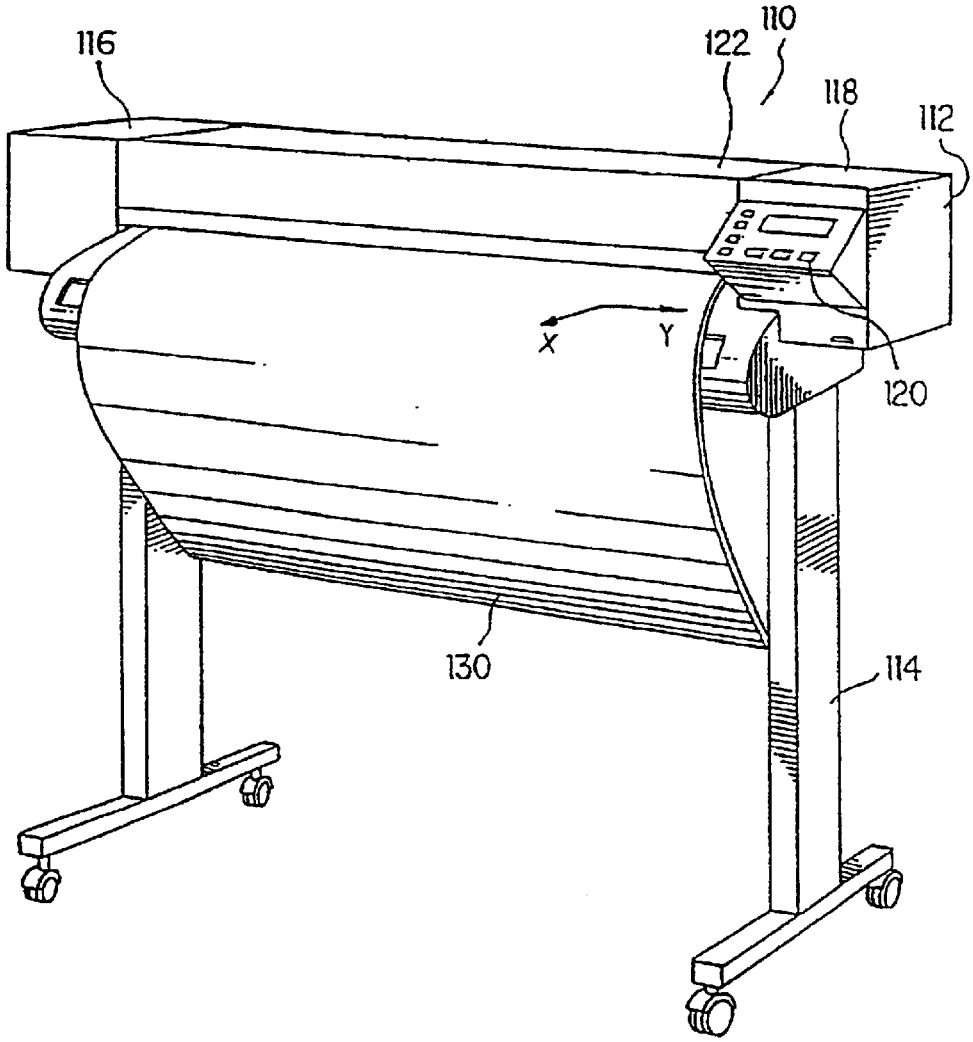
FIG. 1 is a perspective view of an inkjet printer incorporating the features of the present invention.

Referring to FIG. 1, a printer 110 includes a housing 112 mounted on a stand 114. The housing has left and right drive mechanism enclosures 116 and 118, and a cover 122. A control panel 120 is mounted on the right enclosure 118. A print media 130, such as media, is positioned along a media axis denoted as the X axis. A second axis, perpendicular to the X axis, is denoted as the Y axis.

Figure 2:
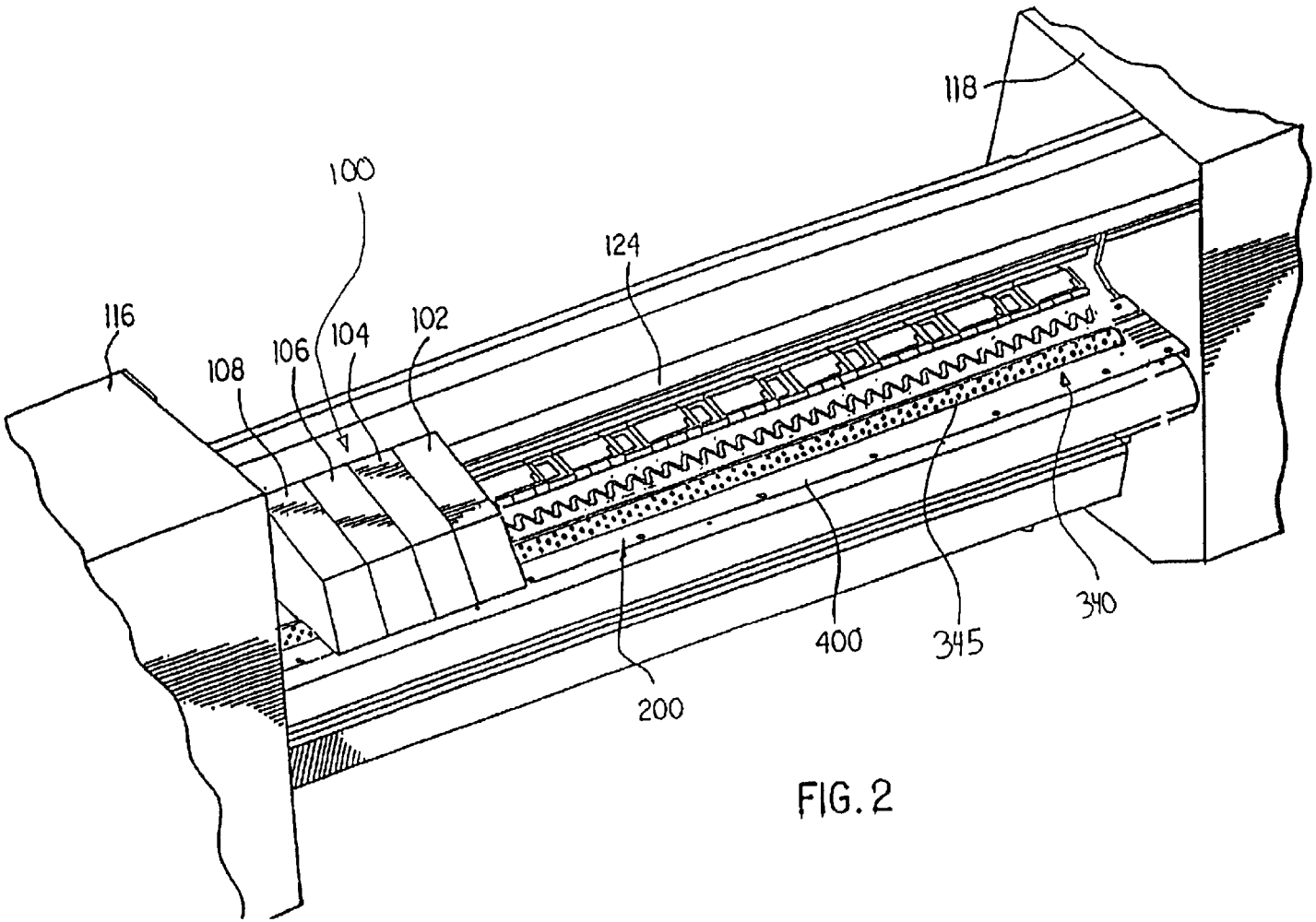
FIG. 2 is a diagram of a media advancing device of the printer of FIG. 1 without a shim.

Referring now to FIG. 2, a media outputting device is globally referenced as 200 and includes the media advancing device globally referenced as 340 that will be discussed in more detail with respect to FIG. 3. The outputting device 200 is located between the left and right drive mechanism enclosures 116 and 118. The width of the outputting device 200 measured along the Y axis (shown in FIG. 1) is at least equal to the maximum allowable width of the media. In this embodiment, the width of the outputting device 200 should allow the advancement of media having width up to 36 inches, i.e., 914 mm. However, a larger or smaller media may be advanced according to the capabilities of the hardcopy apparatus in which the media outputting device is being utilized.

A carriage assembly 100 is adapted for reciprocal motion along carriage bar 124. The carriage assembly 100 comprises four inkjet printheads 102, 104, 106, 108, each having printhead nozzles and adapted to store ink of different colors, e.g., black, magenta, cyan and yellow ink, respectively. Inkjet printheads 102, 104, 106, 108, are held rigidly in movable carriage 100 so that the nozzles are above the surface of a portion of media 130 that lays substantially flat on flat stationary platen 400. As carriage assembly 100 moves relative to media 130 along the X and Y axis (shown in FIG. 1), selected nozzles of printheads 102, 104, 106, 108 are activated and ink is applied to media 130. The colors from the color printheads are mixed to obtain any other particular color.

Figure 3:
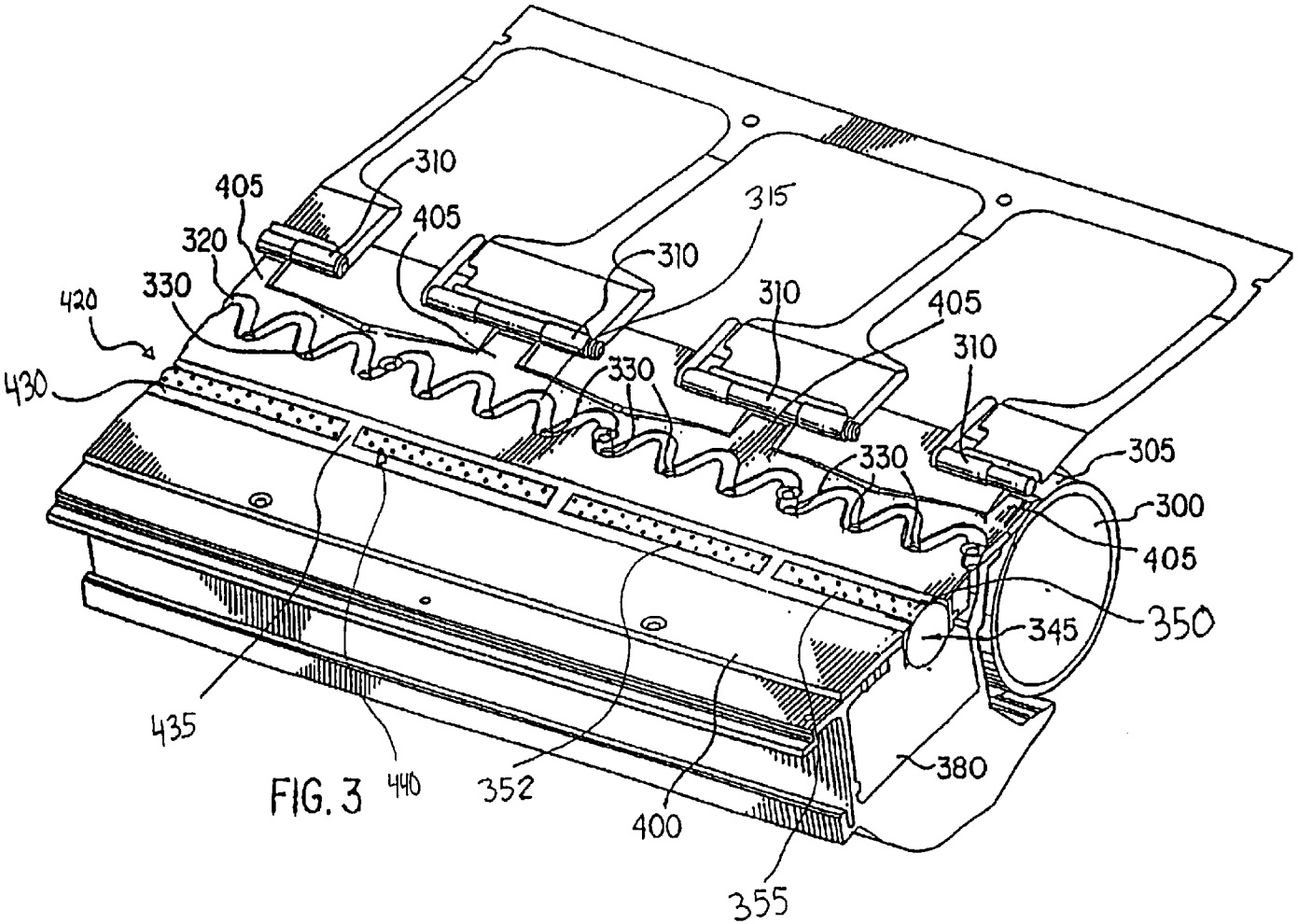
FIG. 3 depicts a cutaway, perspective view of a portion of the media advancing device of FIG. 2 with a shim.

Referring to FIG. 3, media outputting device 200 includes platen 400 and media advancing device 340. Platen 400 is a flat surface that extends from the front of printer 110 to main driving roller 300. Platen 400 comprises a plurality of vacuum holes 330 connected to atmosphere and to vacuum chamber 380. Vacuum chamber 380 is in fluid communication with a vacuum source, which in this embodiment is a fan that is not shown in the drawings, such that the vacuum source generates an air flow by sucking air from the atmosphere through holes 330 into vacuum chamber 380. Due to the pressure differential between atmospheric pressure on the surface of media 130 and the vacuum applied through holes 330 to the back of media 130, the portion of the media closest to holes 330 adheres to platen 400. In order to reduce the loss of air from vacuum chamber 380, holes 330 are distributed at a certain distance from main roller 300. According to this embodiment, a plurality of holes 330 lay in a line at a distance preferably between about 10 mm to about 30 mm from main roller 300, and more preferably about 19 mm from main roller 300.

Platen 400 further comprises a plurality of substantially linear grooves 315 having a wave like shape such that the top of the wave is closest to main roller 300 and the bottom of the wave is farthest from main roller 300. Grooves 315 are linked together to form continuous wave channel 320, which crosses substantially the whole width of platen 400. Preferably, channel 320 has a depth greater than about 0.5 mm, and more preferably about 1 mm, and a width between about 3 mm to about 8 mm, and more preferably about 5 mm. Furthermore, a high vacuum may crease the media if the grooves of channel 320 are wide and run parallel to the media advance direction. Therefore, grooves 315 preferably run at an angle of about 45° with respect to the media axis X. Thus, the angles of grooves 315 optimize the channel width in order to minimize creases in the media and to evenly distribute the vacuum.

The plurality of vacuum holes 330 are positioned in wave channel 320, preferably at the bottom of the wave, farthest from main roller 300. Holes 330 have a diameter between about 1.5 mm to about 3.5 mm, and more preferably about 2.5 mm.

The continuous shape of wave channel 320 evenly distributes the vacuum along print zone 450. Although the preferred embodiment links the plurality of grooves 315 together in order to form a continuous channel 320 for achieving the above described advantage, alternatively, the plurality of grooves may be separated.

Platen 400 further comprises slot 420 extending along the Y axis about a length equal to, or slightly less than the maximum allowable width of the media. Slot 420 partially houses overdrive roller 345 which will be discussed later in more detail.

A plurality of pinch wheels 310 are positioned above a rear portion of platen 400 and are controlled to periodically index or convey media 130 across the surface of platen 400. In this embodiment, for example, there are 12 pinch wheels 310, of which only four are shown in FIG. 3. However, the number of pinch wheels may vary according to the hardcopy apparatus being utilized. The force between each pinch wheel 310 and main roller 300 is preferably between about 3.33 N to about 5 N, and more preferably about 4.15 N. This pinch wheel distribution and force help to drive media 130 straight with irrelevant lateral slippage.

Main roller 300 has an outer surface having a plurality of circumferencial recesses 305 housing a corresponding plurality of protrusions 405 of platen 400. Protrusions 405 extend from the rear of platen 400 towards the rear of printer 110. This combination of features allows media 130 to reliably move between main roller 300 and platen 400.

Figure 4:
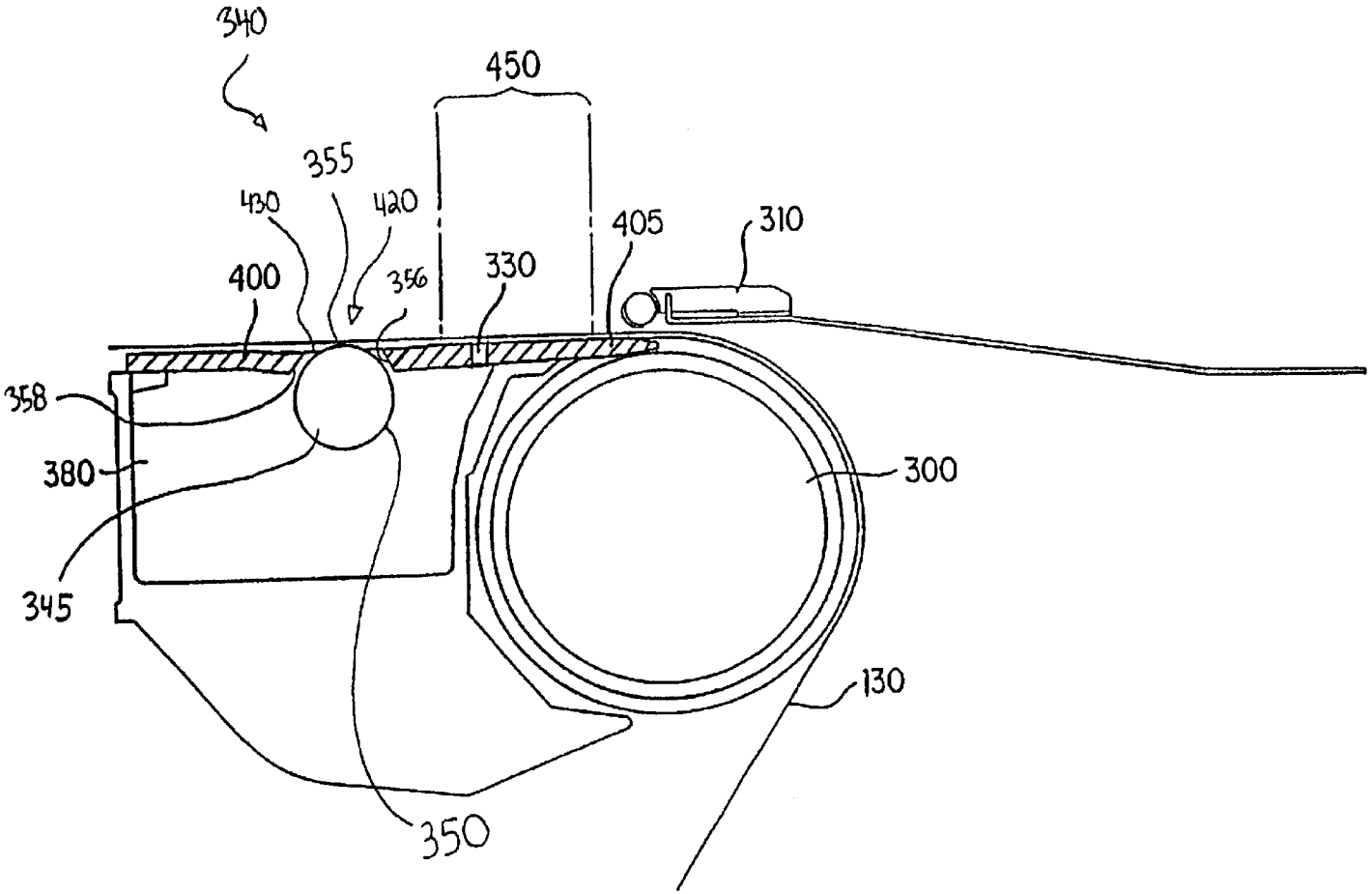
FIG. 4 is a cross-sectional view of the media advancing device of FIG. 2.

Referring to FIGS. 3 and 4, media advancing device 340 comprises an overdrive roller 345 and may include vacuum chamber 380. Overdrive roller 345 is a hollow cylinder and is rotatably mounted partially within slot 420 between first platen edge 356 and second platen edge 358. Overdrive roller 345 has a length slightly less than the length of slot 420 and an outer surface 350 having a plurality of openings 352 and a contact region 355. Openings 352 are preferably circular in shape but other shapes may be used in order to facilitate the flow of air through the openings. Openings 352 preferably have a radius of about 0.5 mm to about 1.0 mm. Openings 352 are positioned along outer surface 350 in order to equally distribute the negative pressure along overdrive roller 345. In this embodiment, openings 352 are positioned in offsetting rows, equidistantly set apart, along the entire outer surface 350. The distance between openings 352 is preferably about 4 mm to about 10 mm.

Although this embodiment of advancing device 340 has a continuous overdrive roller 345 that extends almost the length of slot 420 in order to supply equal traction to each part of media 130, a plurality of rollers, in strict contact with one another or separated from one another, may also be employed.

Overdrive roller 345 may also have a coating with a high coefficient of friction on outer surface 350. Preferably, the coating is made from rubber, silicone, ceramic or metal grit and the like. Combinations of these materials may also be used. More preferably, the coefficient of friction for the coating is about 0.6 to about 1.1.

In this embodiment, running axially beneath slot 420 and overdrive roller 345, is a vacuum chamber 380 such that the overdrive roller is partially housed in the chamber through slot 420. In this embodiment, vacuum chamber 380 is in fluid communication with slot 420 through openings 352.

Contact region 355 of roller 345 is that area of the roller that is located between first and second edges 356 and 358, and which engages the back of media 130. As a result of the vacuum created by the vacuum source, air flows from atmosphere through openings 352 in contact region 355 through openings 352 in the remaining portion of outer surface 355 and into vacuum chamber 380. Preferably, the vacuum level is about 2 to about 8 inches of $H_2O$. This vacuum creates a negative pressure distribution directly upon overdrive roller 345 in the area of contact region 355. The negative pressure distribution causes the back of media 130 to engage with contact region 355.

The traction force, resulting from the negative pressure distribution, between media 130 and overdrive roller 345 is preferably between about 0.6 N to about 1 N, and more preferably about 0.8 N.

A shim 430 may be positioned over slot 420, extending the length and width of the slot and having a gap 440. Shim 430 may also include at least one transversal rib 435 transversing gap 440 such that a plurality of smaller gaps are formed in shim 430. Preferably, these smaller gaps are of equal size in order to equally distribute the negative pressure along contact region 355. Gap 440 is aligned over contact region 355 and engages with first and second platen edges 356 and 358 providing for an entrance for air through slot 420 into vacuum chamber 380. Preferably, gap 440 is engaged with slot 420 so that openings 352 in contact region 355 are the only entrance for air through slot 420 into vacuum chamber 380. The size of gap 440 can be varied according to the rigidity of media 130 that is being advanced and the amount of adherence of the media to overdrive roller 345 that is sought.

Alternatively, annular grooves may be formed in outer surface 350 to house transverse ribs 435. To transmit the proper traction force to media 130, the overdrive interference, i.e., the distance between the surface of platen 400 and the top of overdrive roller 345, would preferably be between about 0.3 mm to about 0.6 mm. Below 0.25 mm the traction force reduces rapidly, towards zero traction force at zero interference; while an interference larger than 0.65 mm may result in wrinkles created by overdrive roller 345 extending to print zone 450.

Figure 5:
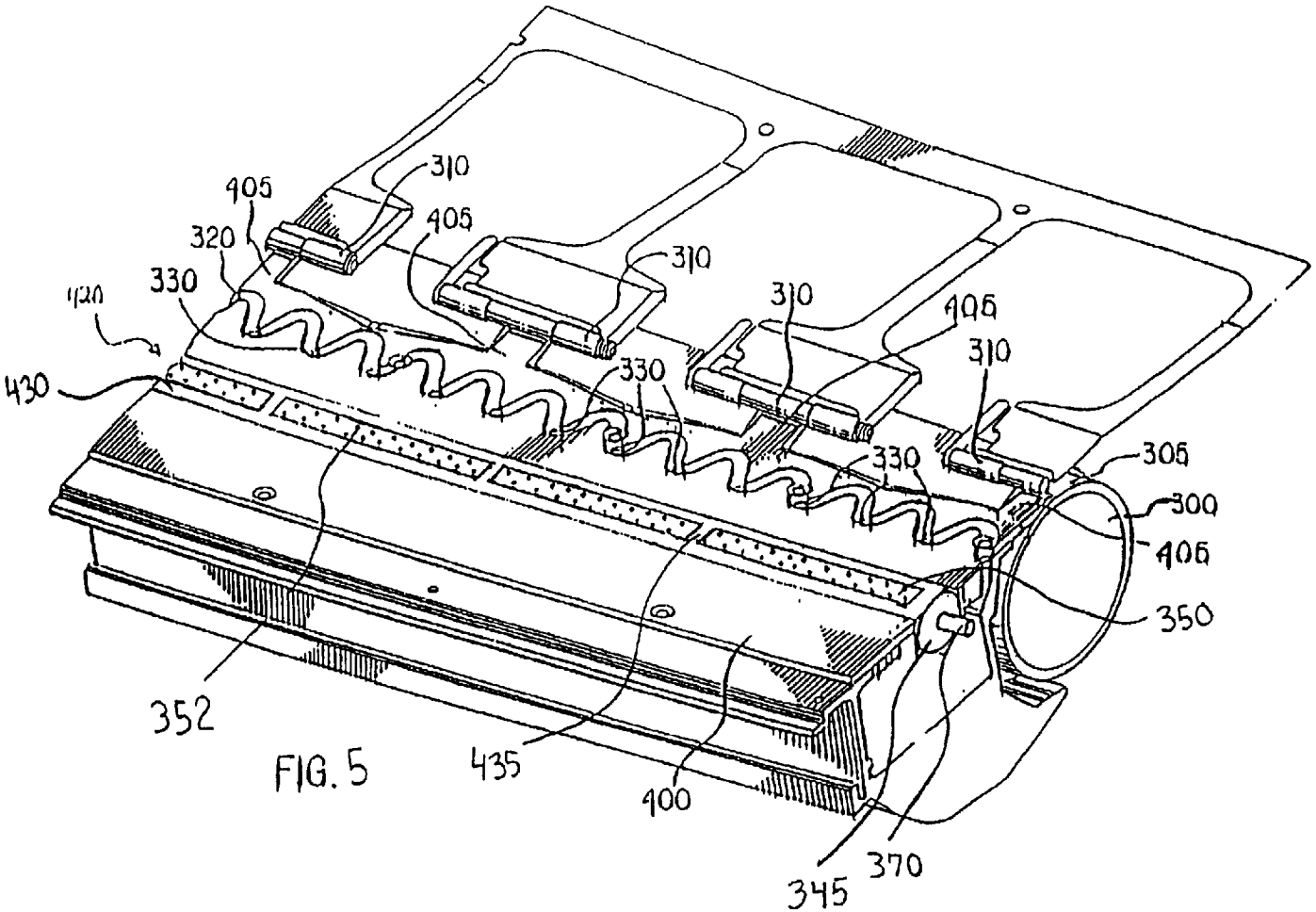
FIG. 5 depicts a cutaway, perspective view of a portion of a second embodiment of a media advancing device of the present invention.

Referring to FIG. 5, an alternative embodiment of the media advancing mechanism is shown. Overdrive roller 345 further comprises at least one axial exhaust 370. In this alternative embodiment, there is one axial exhaust 370 but a plurality of axial exhausts may be used in order to facilitate the flow of air. Axial exhaust 370 is in fluid communication with the vacuum source and openings 352 such that air flows from atmosphere through openings 352 in contact region 355 through axial exhaust 370 to the vacuum source. This vacuum creates a negative pressure distribution directly upon overdrive roller 345 in the area of contact region 355. The negative pressure distribution causes the back of media 130 to engage with contact region 355.

Media advancing device 340 utilizes a negative pressure distribution directly upon overdrive roller 345 to create the necessary traction force for advancement or outputting of media 130. By distributing the negative pressure directly upon overdrive roller 345 through the plurality of openings 352, the present invention increases the traction force as compared to devices that apply the negative pressure tangentially to the overdrive roller. This increase of traction force further allows for smaller trailing margins because the overdrive roller is capable of exclusively advancing the media after the media has been released from the main drive roller.

Advancing Operation

Figure 6:
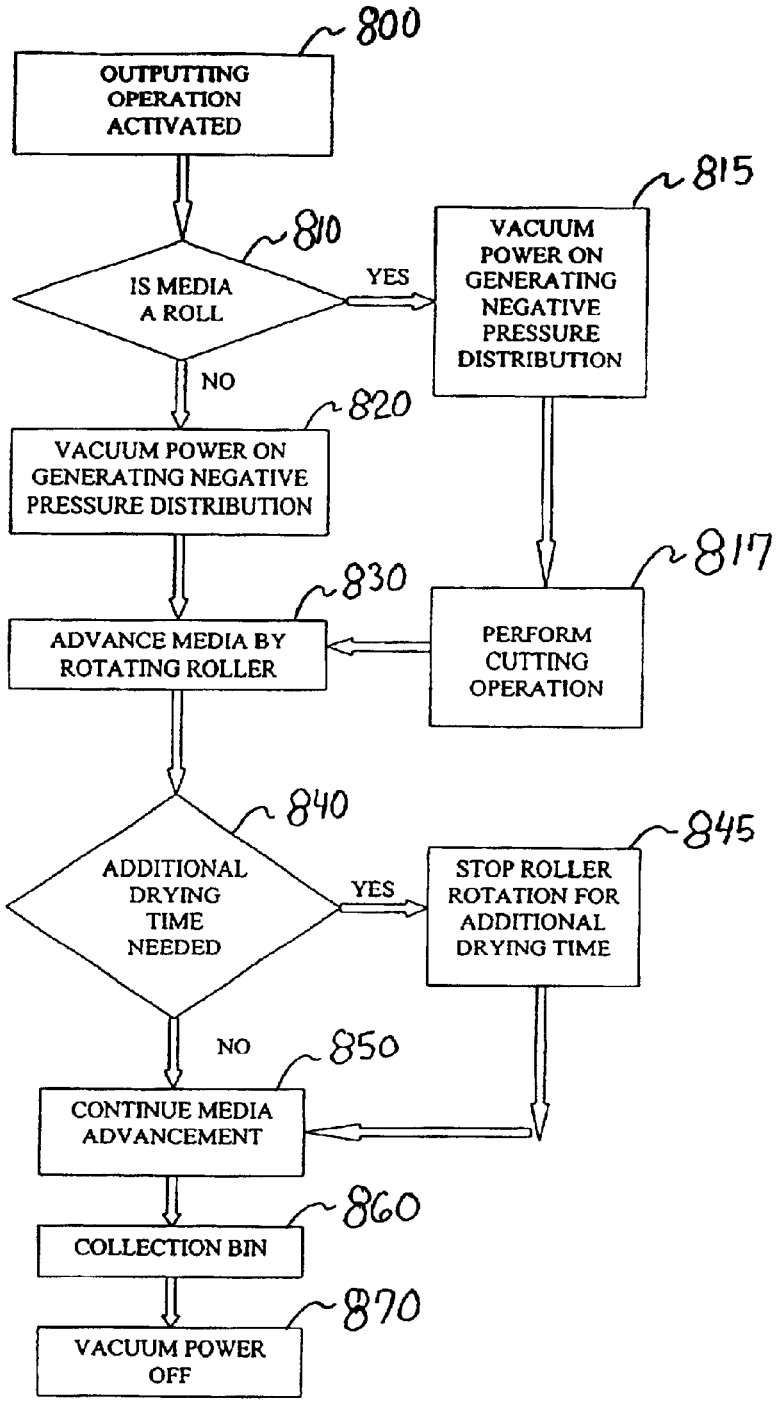
FIG. 6 is a flow chart depicting a method for advancing media according to the apparatus of FIG. 2.

Referring to FIG. 6, an advancing operation may be activated either automatically when a printing operation has been completed or aborted, or manually by a user's request, as shown in step 800.

When the operation is activated, printer 110 verifies if media 130 to be outputted is a cut sheet or a roll (step 810). If media 130 is a roll a cutting step is performed. This means that media 130 is advanced to the cutting position and the vacuum source is powered creating a negative pressure distribution through roller 345 and through platen 400 in order to tension the media and hold the media substantially flat while minimizing movement (step 815). This allows a blade (not shown) to traverse media 130 along the Y axis to cut the media, as shown in step 817.

Once the roll has been cut or if media 130 is a cut sheet, the media is advanced along the X axis towards the front of printer 110 away from main roller 300 (step 830).

The advancement of media is performed by engagement of a portion of the back of media 130 with contact region 355, due to the negative pressure generated by the vacuum source through openings 352 in contact region 355, and rotation of overdrive roller 345.

If the ink printed onto media 130 requires additional drying time (step 840), the overdrive roller rotation may be stopped when most of the printout is advanced out of the printer (step 845), e.g., as shown in FIG. 1. The vacuum source is kept on for the required time to tension media 130 and assist in drying.

Media 130 can then continue its advancement or output from printer 110 (step 850), preferably into a conventional collecting bin, as shown in step 860. The vacuum source is then powered off (step 870).

The present invention having thus been described with particular reference to the preferred forms thereof, it will be obvious that various changes and modifications may be made therein without departing from the spirit and scope of the present invention as defined in the appended claims. Furthermore, the skilled artisan will appreciate that, in accordance with the preferred embodiment, the same media advancing device may be capable of being employed to perform a plurality of different operations, such as loading and feeding operations, through use of the above-described "direct" negative pressure distribution.

What is claimed is:

1. A media advancing device for a hardcopy apparatus comprising:

a main drive roller that advances a media toward at least one overdrive roller having an outer surface and being rotatable for further advancing said media, said outer surface comprising a plurality of openings and a contact region for engaging said media; and a negative pressure mechanism for creating negative pressure through at least a portion of said openings, wherein said roller is partially housed in at least one slot in said negative pressure mechanism such that said opening provide an entrance for air through said slot into said negative pressure mechanism.

2. The media advancing device according to claim 1, wherein said negative pressure mechanism comprises at least one vacuum source in communication with at least one vacuum chamber, wherein said vacuum chamber is in communication with at least a portion of said openings.

3. The media advancing device according to claim 2, wherein said roller is partially housed in at least one slot above said vacuum chamber, and said openings are in said contact region and provide the only entrance for air through said slot into said vacuum chamber.

4. The media advancing device according to claim 1, wherein said openings are circular.

5. The media advancing device according to claim 1, wherein said opening are equidistantly spaced apart.

6. The media advancing device according to claim 1, wherein said outer surface further comprises a coating having a high coefficient of friction.

7. The media advancing device according to claim 1, wherein said roller further comprises at least one axial exhaust and said negative pressure mechanism comprises at least one vacuum source in communication with said axial exhaust, said axial exhaust being in communication with at least a portion of said openings.

8. A media advancing device for a hard copy apparatus comprising:

at least one roller having an outer surface and being rotatable for advancing media, said outer surface comprising a plurality of opening and a contact region for engaging said media;

a negative pressure mechanism for creating negative pressure through at least a portion of said opening, wherein said negative pressure mechanism comprises at least one vacuum source in communication with at least one vacuum chamber, wherein said vacuum chamber is in communication with at least a portion of said opening, and wherein said roller is partially housed in at least one slot above said vacuum chamber, and said opening are in said contact region and provide the only entrance for air through said slot into said vacuum chamber; and at least one shim disposed above said slot and having a gap, said gap aligning over at least a portion of said contact region.

9. The media advancing device according to claim 8, wherein said shim further comprises at least one transverse rib forming a plurality of smaller gaps.

10. The media advancing device according to claim 9, wherein said smaller gaps are about equal in size.

11. The media advancing device according to claim 8, wherein said shim is made of a flexible material.

12. A media advancing device for a hardcopy apparatus comprising:

a main drive roller that advances a media toward at least one overdrive roller having an outer surface with a contact region for engaging said media and rotatable for further advancing said media; and a negative pressure mechanism for creating negative pressure that is radial to at least a portion of said contact region, wherein said outer surface further comprises a plurality of openings and said negative pressure mechanism comprises at least one vacuum source in communication with at least one vacuum chamber, said vacuum chamber being in communication with at least a portion of said openings, and wherein said roller is partially housed in at least one slot in said negative pressure mechanism such that said openings provide an entrance for air through said slot into said negative pressure mechanism.

13. The media advancing device according to claim 12, wherein said roller is partially housed in at least one slot above said vacuum chamber, and said openings are in said contact region and provide the only entrance for air through said slot vacuum chamber.

14.The media advancing device according to claim 12, wherein said openings are circular.

15. The media advancing device according to claim 12, wherein said openings are equidistantly spaced apart.

16. The media advancing device according to claim 12, wherein said outer surface further comprises a coating having a high coefficient of friction.

17. The media advancing device according to claim 12, wherein said roller further comprises at least one axial exhaust, said outer surface further comprises a plurality of openings and said negative pressure mechanism comprises at least one vacuum source in communication with said axial exhaust, said axial exhaust being in communication with at least a portion of said openings.

18. A media advancing device for a hard copy apparatus comprising:

at least one roller having an outer surface with a contact region for engaging media and rotatable for advancing said media;

a negative pressure mechanism for creating negative pressure that is radial to at least a portion of said contact region, wherein said outer surface further comprises a plurality of openings and said negative pressure mechanism comprises at least one vacuum source in communication with at least one vacuum chamber, said vacuum chamber being in communication with at least a portion of said openings, and wherein said roller is partially housed in at least one slot above said vacuum chamber, and said openings are in said contact region and provide the only entrance for air through said slot into said vacuum chamber; and at least one shim disposed above said slot and having a gap, said gap aligning over at least a portion of said contact region.

19. The media advancing device according to claim 18, wherein said shim further comprises at least one transverse rib forming a plurality of smaller gaps.

20. The media advancing device according to claim 19, wherein said smaller gaps are about equal in size.

21. The media advancing device according to claim 18, wherein said shim is made of a flexible material.

* * * * *